United States Patent [19]

Tamaru et al.

[11] Patent Number: 4,468,082

[45] Date of Patent: Aug. 28, 1984

[54] TERMINAL ASSEMBLY FOR CIRCUIT INTERRUPTER

[75] Inventors: Shigemi Tamaru; Yasushi Genba; Takayoshi Ishikawa; Kiyoshi Eguchi; Hideshi Takashita, all of Fukuyama, Japan

[73] Assignee: Mitsubishi Denki Kabushiki Kaisha, Tokyo, Japan

[21] Appl. No.: 398,699

[22] Filed: Jul. 15, 1982

[30] Foreign Application Priority Data

Jul. 17, 1981 [JP] Japan ..... 56-106953[U]

[51] Int. Cl.[3] ..... H01R 23/02

[52] U.S. Cl. ..... 339/176 M; 339/210 M; 339/217 R

[58] Field of Search ..... 339/136 M, 138, 176 M, 339/198 G, 198 GA, 198 H, 206 R, 210 R, 210 M, 217 R

[56] References Cited

U.S. PATENT DOCUMENTS 2,918,647 12/1959 Britt ..... 339/74 R
3,920,309 11/1975 Garver ..... 339/198 G

FOREIGN PATENT DOCUMENTS 1345089 10/1963 France ..... 339/198 GA
1437480 10/1968 France ..... 339/176 M
1487520 4/1969 France ..... 339/198 H
2254126 7/1975 France ..... 339/198 H
29988 2/1980 Japan .
1014915 12/1965 United Kingdom ..... 339/176 M
1149372 4/1969 United Kingdom ..... 339/198 GA

*Primary Examiner*—John McQuade
*Attorney, Agent, or Firm*—Wenderoth, Lind & Ponack

[57] ABSTRACT

The disclosed terminal assembly for a circuit interrupter comprises three pairs of opposite source and load terminals, each pair being carried on both lateral sides by a pair of first and second side plates by having each lateral side and a recess on that side engaging an associated groove and a raised portion on the front surface of each side plate respectively and connected to adjacent pairs of the opposite source and load terminals through different pairs of the first and second side plates interconnected back to back. All the terminals and side plates are assembled into a unitary structure between two metallic plates by means of bolts and nuts. A supporting strut includes two notches fitted onto the lateral surfaces of end portions of each pair of the opposite source and load terminals and is disposed on each of the side plates. The outermost strut is connected to the adjacent metallic plate trough a lateral locking member and each pair of the intermediate struts are interconnected back to back and connected to the interconnected first and second plates through an intermediate locking member.

4 Claims, 27 Drawing Figures

FIG. 6D
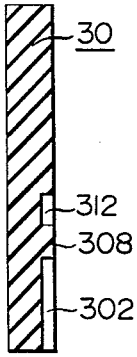
FIG. 6A
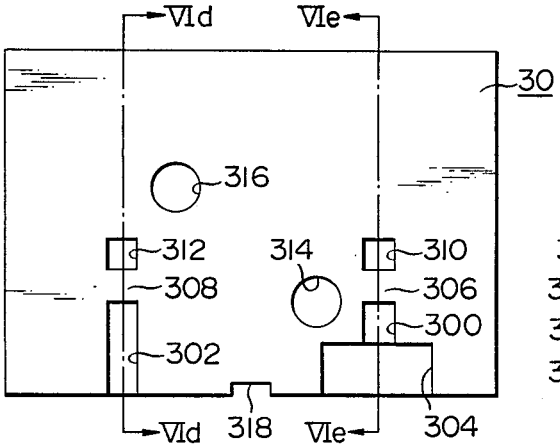
FIG. 6E
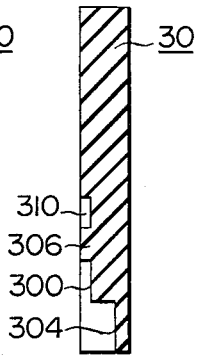
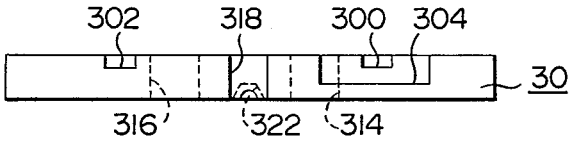
FIG. 6B
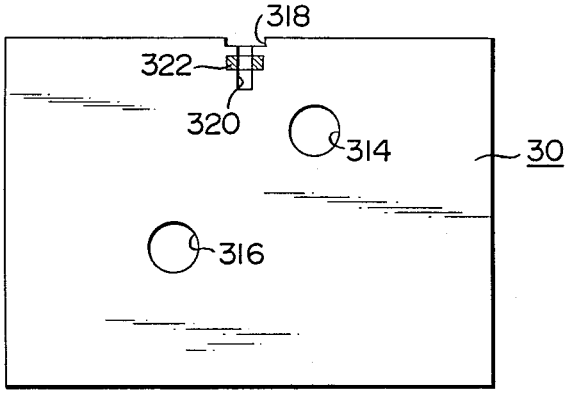
FIG. 6C
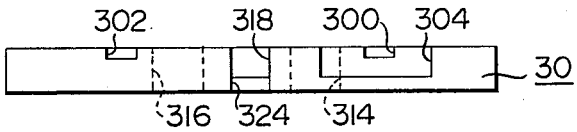
FIG. 6F
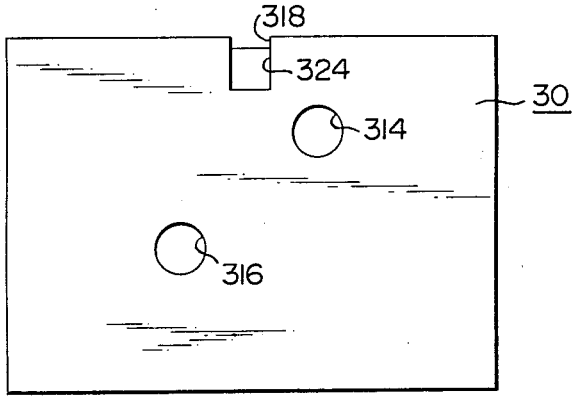
FIG. 6G

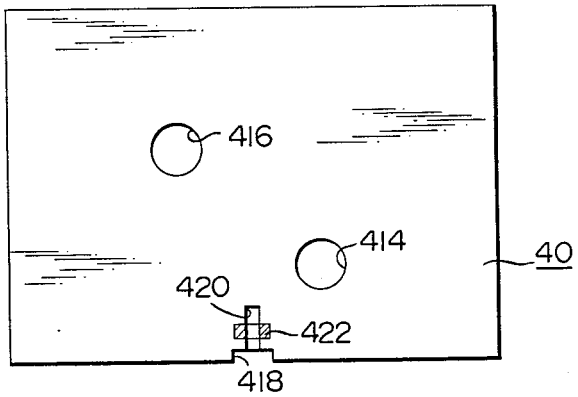
FIG. 7A
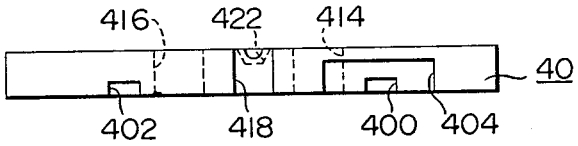
FIG. 7B
FIG. 7C
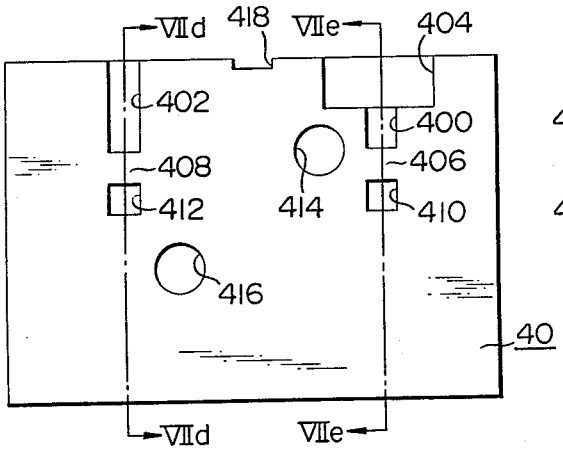
FIG. 7D
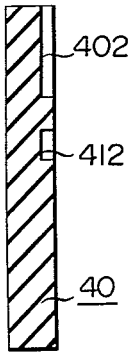
FIG. 7E
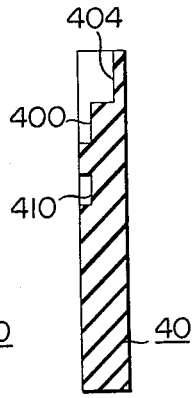
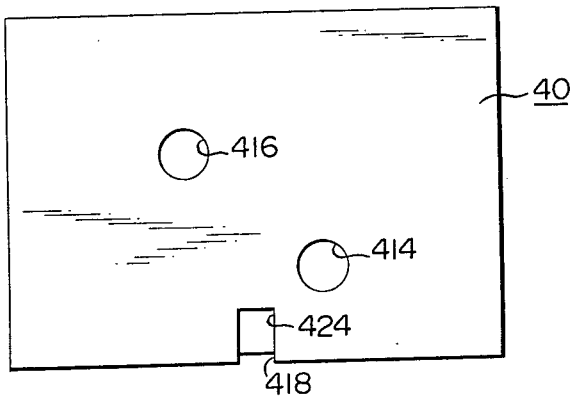
FIG. 7F
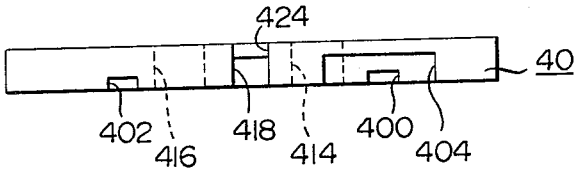
FIG. 7G

TERMINAL ASSEMBLY FOR CIRCUIT INTERRUPTER

BACKGROUND OF THE INVENTION

This invention relates to a terminal assembly for a circuit interrupter, and more particularly to a terminal assembly used with a circuit interrupter to connect a plurality of source terminals and a plurality of load terminals of a circuit interrupter to external electric conductors respectively.

High capacity circuit interrupters generally include a terminal assembly having a structure which is extremely strong and which has good electric insulation because such circuit interrupters generally produce a high electromagnetic force upon the occurrence of a shortcircuit current. A general form of conventional terminal assemblies for a high capacity circuit interrupter has comprised a plurality of source terminals connected to circuits on the source side within the particular circuit interrupter and also to external electric conductors respectively, and a plurality of load terminals connected to circuits on the load side within the circuit interrupter respectively, the arrangement being that those source terminals oppose associated ones of the load terminals, there being one pair of opposite source and load terminals for each of the phases of the circuit interrupter. For example, a terminal assembly for a three phase circuit interrupter includes three pairs of source and load terminals disposed in parallel to one another thereon. Then the plurality of the source and load terminal pairs have electrically insulating side plates therebetween and which are greater in number than the number of the terminal pairs, and a pair of metallic plates are disposed on the outer sides of the outermost side plates respectively. A plurality of bolts extend through the metallic and side plates and are fastened to the metallic plates by means of nuts thereby to fix the source and load terminals to one another.

From the foregoing it is seen that in the conventional terminal assembly, the source terminals, the load terminals and the side plates are collected into separate units each including a plurality of the components and that, after their assembling, the components are connected together into a unitary structure by bolt and nut means.

Thus conventional terminal assemblies such as described above have been disadvantageous in that the assembling operation thereof is extremely difficult, and there is a fear that the source and load terminals may damage the components adjacent thereto due to magnetic forces developed therein, for example because those terminals are permitted only to be fixed to the associated side plates along a relatively short portion thereof.

Accordingly it is an object of the present invention to provide a new and improved terminal assembly for a circuit interrupter capable of being easily assembled and including a plurality of source terminals and a plurality of load terminals which are prevented from shifting due to the magnetic force developed thereon.

SUMMARY OF THE INVENTION

The present invention provides a terminal assembly for a circuit interrupter comprising a plurality of source terminals one for each of the phases of the circuit interrupter, a plurality of load terminals disposed in spaced opposed relationship with the source terminals respectively, a plurality of pairs of first and second side plates, each of the first and second side plates including on a front surface thereof a pair of parallel grooves for having fitted thereinto a lateral edge of the opposed source and load terminals respectively, a plurality of bolts extending through the first and second side plates, and a supporting strut for fixing the end portion of each pair of the source and load terminals.

In a preferred embodiment of the present invention each pair of the source and load terminals are carried by one pair of first and second side plates and further have a raised and a recessed portion on the respective lateral surfaces of each of the source and load terminals fitted into and onto a recessed and a raised portion on the front surface of each of the first and second side plates. The respective pairs of source and load terminals are connected to adjacent pairs of the source and load terminals by having the side plates for adjacent pairs of source and load terminals connected back to back. The plurality of pairs of source and load terminals and the plurality of first and second side plates are put in a unitary structure between a pair of metallic plates and a pair of bolts extends through the plurality of first and second side plates and the pair of metallic plates, and each of the supporting struts includes a pair of notches fitted onto the lateral surfaces of end portions of a mating pair of the source and load terminals and is disposed on a lateral surface of an associated one of the first and second side plates, the outermost supporting strut being fixedly secured to an adjacent one of the metallic plates by a lateral locking metallic member and each pair of the intermediate supporting struts being connected back to back and fixedly connected to the connected first and second side plates by an intermediate locking metallic member.

BRIEF DESCRIPTION OF THE DRAWINGS

The present invention will become more readily apparent from the following detailed description taken in conjunction with the accompanying drawings in which:

FIG. 6A is a front view of the first side plate shown in FIGS. 1, 2 and 3;

FIG. 6B is a side elevational view of the plate shown in FIG. 6A;

FIG. 6C is a rear plan view of the plate shown in FIG. 6A;

FIGS. 6D, and 6E are cross sectional views of the plate shown in FIG. 6 with the cross sections taken along the lines VId—VId and VIe—VIe of FIG. 6A respectively;

FIG. 6F is a side elevational view of the outermost one of the first side plates shown in FIGS. 2 and 3;

FIG. 6G is a rear plan view of the plate shown in FIG. 6F;

FIG. 7A is a rear plan view of the second side plate shown in FIGS. 1, 2 and 3;

FIG. 7B is a side elevational view of the plate shown in FIG. 7A;

FIG. 7C is a front plan view of the plate shown in FIG. 7A;

FIGS. 7D and 7E are cross sectional views of the plate shown in FIG. 7A with the cross sections taken along the lines VIId—VIId and VIIe—VIIe of FIG. 7C;

FIG. 7F is a rear plan view of the outermost one of the second side plate shown in FIGS. 2 and 3;

FIG. 7G is a side elevational view of the plate shown in FIG. 7F;

DESCRIPTION OF THE PREFERRED EMBODIMENT

Figure 1:
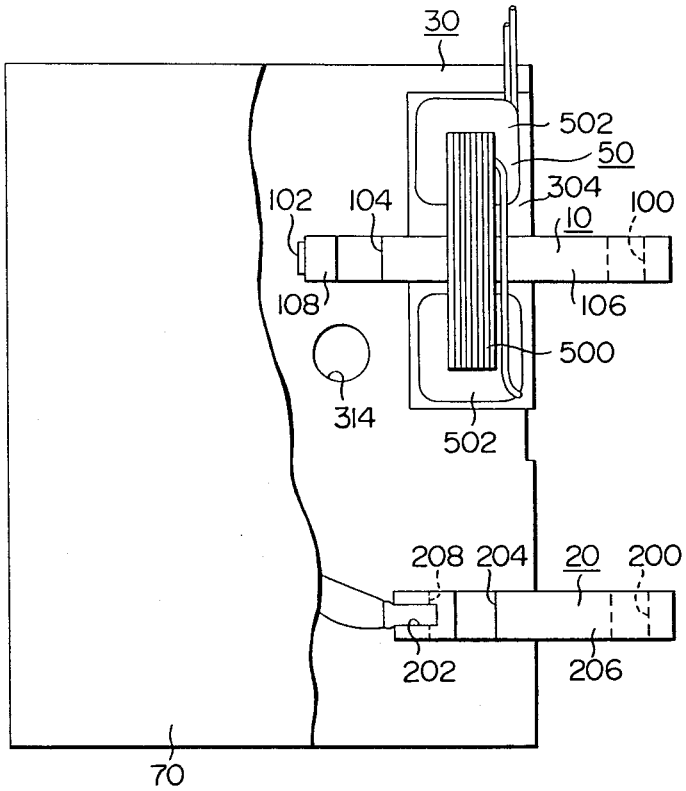
FIG. 1 is a side elevational view, partly in section, of one embodiment of the terminal assembly according to the present invention used with a circuit interrupter with a part cut away and with some parts omitted.
Figure 2:
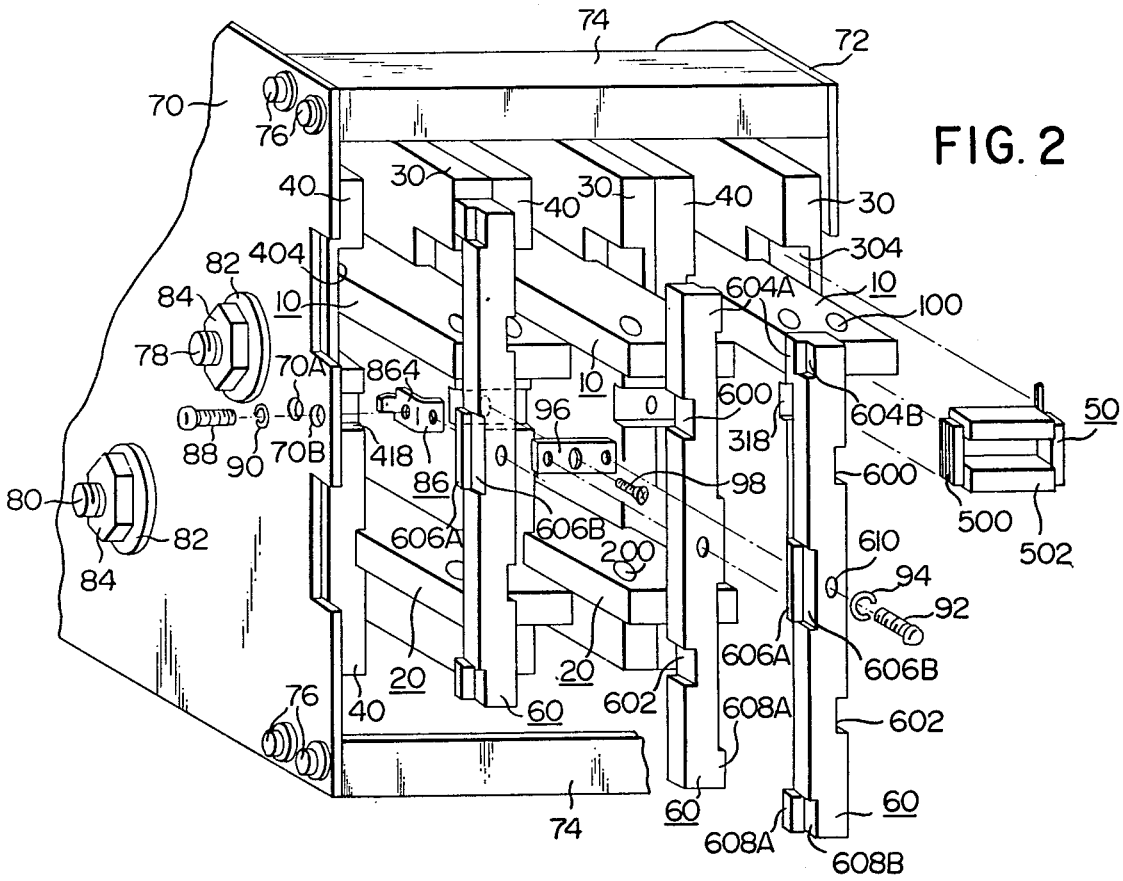
FIG. 2 is an exploded perspective view of the arrangement shown in FIG. 1 with some parts omitted.
Figure 3:
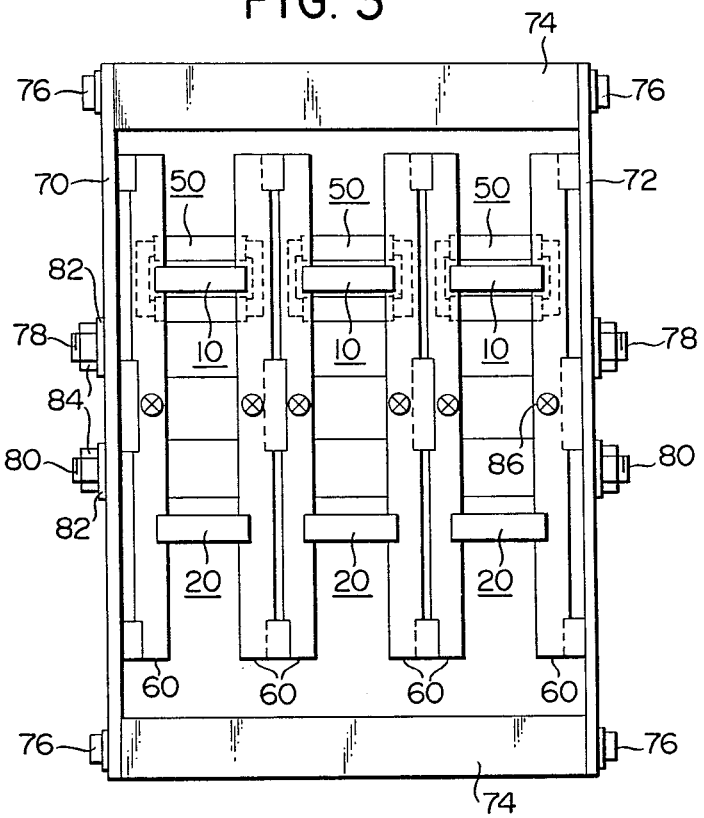
FIG. 3 is a front view of the arrangement shown in FIG. 1.

Referring now to FIGS. 1, 2 and 3 of the drawings, there is illustrated one embodiment of the terminal assembly according to the present invention and used with a three phase interrupter. The arrangement illustrated comprises a plurality of strip-shaped source terminals 10, in this case, three source terminals, one for each phase of the circuit interrupter, disposed at predetermined equal intervals in a common plane, and a plurality of strip-shaped load terminals 20 equal in both width and thickness to the source terminals 10, in the case three load terminals, disposed in the same manner as the source terminals 10 and spaced therebeneath as viewed in FIGS. 2 and 3, one for each source terminal 10 in opposed and parallel vertically spaced relation to the source terminals 10 respectively. In the example illustrated the three source terminals 10 and the three load terminals 20 are arranged in two rows and three columns. Then a pair of first and second side plates 30 and 40 respectively having a common rectangular shape (see FIGS. 5 and 6) and made of an electrically insulating material are connected to each other back to back and interposed between each pair of adjacent source terminals 10 and also between each pair of adjacent load terminals 20 and extending perpendicularly to the longitudinal axes of the source and load terminals 10 and 20. The leftmost source and load terminals 10 and 20 are engaged by another second side plate 40 in the same manner as the intermediate source and load terminals 10 and 20 while the rightmost source and load terminals 10 and 20 are engaged by another first side plate 30 in the same manner as the intermediate source and load terminals 10 and 20.

As best shown in FIG. 1 and also in FIG. 3, a through type current transformer 50 is fitted onto the central portion of each source terminal 10. The current transformer 50 includes an iron core 500 in the form of a stack of rectangular frames of silicon steel laminations and a pair of secondary windings 502 disposed around a pair of opposite legs of the iron core and connected to each other as shown best in FIG. 2 to produce thereacross a secondary current proportional to a primary current flowing through the mating source terminal 10.

A supporting strut 60 of an electrically insulating material is positioned to support each of the lateral edges of the source and load terminals 10 and 20 arranged in each column, and shown in FIG. 2 as being nearer to the viewer.

Figure 4:
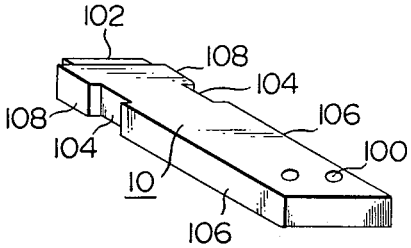
FIG. 4 is a perspective view of the source terminal shown in FIGS. 1, 2 and 3.

FIG. 4 shows the details of the source terminal. As shown, the source terminal 10 has a pair of threaded holes 100 adjacent to one end nearer to the viewer which holes are also shown in FIGS. 1 and 2, and a stationary contact 102 disposed at the other end thereof. Thus the source terminal 10 can be connected at the one end to an associated external electric conductor (not shown) by having a pair of screws (not shown) screw threaded into the holes 100 and can be separably connected at the other end to a mating movable electric conductor (not shown) included in a source circuit (not shown) within the circuit interrupter by having the stationary contact 102 separably engaging a movable contact (not shown) disposed at the end of the movable electric conductor.

Further the source terminal 10 has a pair of rectangular recesses 104 in opposite lateral positions in the lateral edges 106 to define an end face 108 between the recesses 104 and that end of the terminal 10 bearing the stationary contact 102 for the purpose which will be apparent hereinafter.

Figure 5:
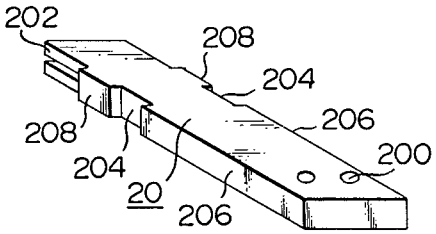
FIG. 5 is a perspective view of the load terminal shown in FIGS. 1, 2 and 3.

FIG. 5 shows the details of load terminal 20. The arrangement illustrated includes a pair of threaded holes 200 disposed adjacent to one end thereof nearer to the viewer, which holes are also shown in FIG. 1, and a laterally extending groove 202 in the other end thereof extending the full width of the terminal. Thus the load terminal 20 can be connected at one end to an associated external electric conductor by having a pair of screws (not shown) screw threaded into the holes 200 and at the other end to an associated flexible electric conductor included in a load circuit (not shown) of the circuit interrupter by inserting the end of the flexible electric conductor into the groove 202 (see FIG. 1).

In other respects the arrangement of FIG. 5 is identical to that shown in FIG. 4 excepting that the load terminal is longer than the source terminal by about the depth of the groove 202 in the length direction of the terminal. Therefore the components of the arrangement shown in FIG. 5 are designated by the same reference numerals identifying the corresponding ones of those shown in FIG. 4, but greater by 100. For example, the reference numeral 204 designates a recess in the lateral edge 206 of the terminal shown in FIG. 5 which corresponds to the recess 104 shown in FIG. 4.

As described above, the three source terminals 10 and the three load terminals 20 for the phases A, B and C are arranged in two rows and three columns and held in place between respective pairs of the laterally spaced opposed first and second side plates 30 and 40 with a plate 30 of one pair interconnected back to back to a plate 40 of the next adjacent pair with the outermost first and second side plates 30 and 40 supported by the outmost pairs of the source and load terminals 10 and 20 respectively, whereby the pair of terminals 10 and 20 for each phase are physically isolated and electrically insulated from each other and from the terminals 10 and 20 for the other phases.

FIGS. 6 and 7 show the details of the first and second side plates 30 and 40 respectively. As shown in FIG. 6A wherein there is illustrated the inner surface of the first side plate 30, i.e. the surface facing inwardly or toward the other plate of the pair, which has a generally rectangular shape and a pair of U-shaped positioning grooves 300 and 302 extending a predetermined distance from one longer side of the rectangle perpendicularly thereto and terminating a predetermined equal distance from that longer side. Also the grooves 300 and 302 are equidistant from a line perpendicular to the longer side of the rectangle and passing through the center thereof. However the groove 300 opens on the center of a rectangular recess 304 disposed on the longer side of the rectangle and which deeper than the groove 300 (see FIG. 6E). The recess 304 has a dimension sufficient to accommodate one lateral portion of the through type current transformer 50 shown in FIGS. 1, 2 and 3. Each of the grooves 300 and 302 has a rectangular recess 310 or 312 aligned therewith, shown in FIG. 6A as being square, and lengthwise thereof at a spacing 306 or 308 shown in FIG. 6A as being rectangular (Also see FIGS. 6D and 6E).

The groove 300 and the recess 310 are so dimensioned that the groove 300 and the recess 310 have that portion of the lateral edge of the source terminal 10 near the threaded holes 100 and the raised face 108 firmly fitted thereinto, respectively, and the spacing 306 forms a raised portion which is firmly fitted into the recess 104 of the source terminal 10.

Similarly the groove 302 and the recess 312 are so dimensioned that the groove 302 and the recess 310 having that portion of the lateral edge of the load terminal 20 near the the threaded holes 200 and the raised face 108 firmly fitted thereinto, respectively, and the spacing 306 forms a raised portion which is firmly fitted into the recess 204 of the load terminal 20.

Also a pair of spaced circular holes 314 and 316 extend through the first side plate 30 adjacent to the diagonal thereof between the grooves 300 and 302 for a purpose which will be apparent later.

Further a rectangular notch 318 is provided at the center of that longer side of the rectangle in which the recesses 302 and 304 open and a short groove 320 having a semicircular cross section extends from the center of the bottom of the notch 318 on the outer surface of the first side plate 30 as shown best in FIG. 6C. A semi-hexagonal nut 322 is embedded in the side plate 30 adjacent to the notch 318 and has cut ends flush with the outer surface and a threaded surface exposed to the semicircular groove 320 and engageable by a bolt (not shown) inserted into the recess 318 and the groove 320. The purpose of the notch 318, the groove 320 and the nut 322 will be apparent hereinafter.

The first side plate 30 disposed on the outermost side or the rightmost side as viewed in FIG. 2 has the details as shown in FIGS. 6F and 6G wherein there are illustrated the longer side and outer surfaces thereof respectively. The arrangement illustrated is different from that shown in FIGS. 6A, 6B, 6C, 6D and 6E only in that in FIGS. 6F and 6G a rectangular shallow recess 324 is disposed on the outer surface of the first side plate 30 which is aligned with and identical in width to the notch 318 and the semicircular groove 320 and the semi-hexagonal nut 322 are omitted.

Thus the components of the outermost first side plate 30 are designated by the same reference numerals identifying the corresponding components on the intermediate first side plate 30. For example, the reference numeral 304 designates a recess on the outermost first side plate 30 for the through type current transformer 50.

From a comparison of FIGS. 6A, 6B, 6C, 6D and 6E with FIGS. 7C, 7B, 6E, 6D and 7A it will readily be understood that the second side plate 40 is a mirror image of the first side plate 30 with respect to a mirror (not shown) disposed in parallel to the inner or outer surface thereof. Thus the components on the second side plate 40 are designated by the same reference numerals identifying the corresponding components on the first side plate 30 but higher by 100. For example, the reference numeral 406 designates a spacing on the second side plate 40 arranged to be fitted into the recess 104 on the source terminal 10 as a raised portion.

The second side plate 40 disposed on the outermost side or the leftmost side as viewed in FIG. 2 has the details as shown in FIGS. 7F and 7G wherein there are illustrated the longer side and rear surfaces thereof. From a comparison of FIGS. 6F and 6G with FIGS. 7F and 7G it is seen that the outermost second side plate 40 is a mirror image of the outermost first side plate 30 with respect to a mirror (not shown) disposed in parallel to the inner or outer surface thereof. Thus the components on the outermost second side plate 40 are designated by the same reference numerals identifying the corresponding components on the outermost first side plate 30 but higher by 100. For example, the reference numeral 422 designates a shallow recess on the rear surface of the second outermost side plate 40.

Figures 8A, 8B, 8C, 8D:
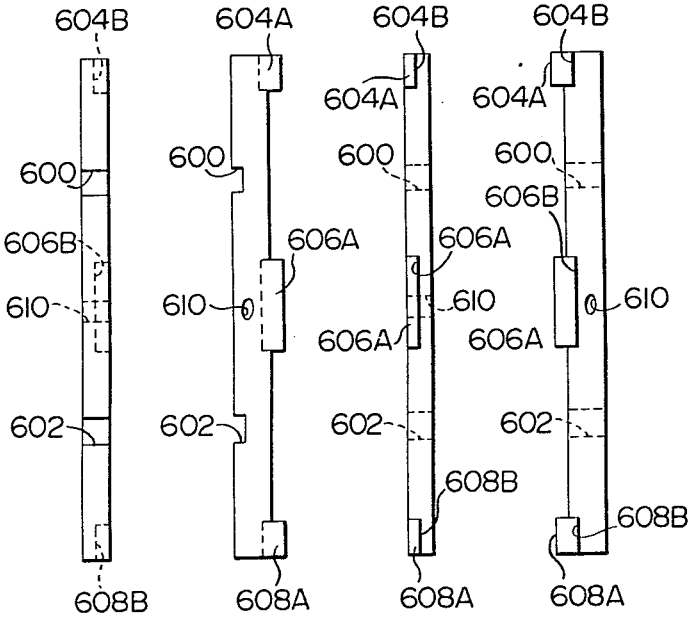
FIG. 8A is a front elevation view of the supporting strut shown in FIG. 2.
FIGS. 8B and 8C are side elevational views of the strut shown in FIG. 8A as viewed from the lefthand and righthand sides thereof in FIG. 8A respectively.
FIG. 8D is a rear elevation view of the strut shown in FIG. 5.

FIG. 8 shows the details of the supporting strut 60 for fixing those end portions of the source and load terminals 10 and 20 having the threaded holes 100 and 200 respectively. FIG. 8A shows the front surface of the supporting strut 60, FIGS. 8B and 8C show the lefthand and righthand lateral surfaces thereof as viewed in FIG. 8A and FIG. 8D shows the rear surface thereof.

The supporting strut 60 has a width somewhat smaller than the thickness of the first or second side plate 30 or 40 for a purpose which will be apparent later and is provided on the lefthand lateral surface as viewed in FIG. 8A with a pair of rectangular notches 600 and 602 disposed at a predetermined interval corresponding to the distance between the spaced source and load terminals 10 and 20 and into which the righthand lateral edges 10 and 20 as viewed in FIGS. 4 and 5 of the terminals 10 and 20 are to be fitted, respectively. Also the supporting strut 60 is provided on the righthand lateral surface as viewed in FIG. 8A with three projections 604A, 606A and 608A, located on the upper end portion, the central portion and the lower end portion respectively and three recesses 604B, 606B and 608B adjacent the respective projections. The projections 604A, 606A and 608A are equal in both length and width to the mating recesses and have a height somewhat greater than the depth of the recesses. It is noted that, after having been turned through an angle of 180 degrees about the longitudinal axis thereof, a supporting strut 60 can engage the lefthand lateral edge as viewed in FIG. 4 or 5 of the hole bearing end portion of each of the source and load terminals 10 and 20.

In order to assemble the source and load terminals 10 and 20 and the first and second side plates 30 and 40 into a unitary structure, a pair of first side plates 30 are connected back to back to respective second side plates to prepare a pair of electrical insulation means intended to be disposed between the phases A and B and between the phases B and C. Then the three source terminals 10 for the phases A, B and C are respectively engaged between an outermost second side plate 40 disposed in spaced opposed relationship with the first side plate 30 of the first interconnected pair of side plates and the lastmentioned first side plate 30, between the second side plate 40 of second interconnected pair of side plates and the first side plate 30 of the second interconnected pair of side plates and by the second side plate 40 of the second interconnected pair of side plates and an outermost first side plate 30 disposed in spaced opposed relationship with the latter. To this end the lateral edges 106 of the source terminal 10 are fitted into the grooves 300 and 400 on the first and second side plates 30 and 40 and the recessed portions 104 and the end faces 108 on the lateral surfaces 106 of the source terminal 10 are fitted onto the raised portions 306 and 406 and with the recesses 310 and 410 in the first and second side plates 30 and 40 respectively.

Subsequently the load terminals 20 are similarly engaged by the first and second side plates 30 and 40. At that time, the load terminal 20 has the lateral edges 206 fitted into the grooves 302 and 402 in the first and second side plates 30 and 40 and the recessed portions 204 and the raised end faces 208 on the lateral edges 206 thereof fitted onto the raised portions 308 and 408 into the recesses 312 and 412 on the first and second side plates 30 and 40 respectively.

Following this, a pair of metallic plates 70 and 72 are disposed in contact relationship on the outer surfaces of the outermost second and first side plates 40 and 30 respectively and a plurality of rectangular supporting members 74 (only two of which are illustrated) are interposed between the metallic plates 70 and 72 and fastened to the latter by means of a pair of screws 76, one pair for each end of a different one of the supporting members 74.

Also a pair of bolts 78 and 80 extend through the holes 314 and 414 in the first and second side plates 10 and 20 which are aligned with one another and holes (not shown) in the metallic plates 78 and 80 and aligned with the holes 314 and 414 respectively, after which each end of each bolt 78 or 80 has a spring washer 82 placed thereover and then has a nut 84 threaded thereon until the source and load terminals 10 and 20 and the first and second side plates 30 and 40 are connected together into a unitary structure with the metallic plates 70 and 82 as shown in FIG. 3.

Subsequently the through type current transformers 50 are placed on each of the source terminals 10 and moved therealong until they are accommodated in the recesses 304 and 404 in the first and second side plates 30 and 40.

Figures 9A, 9B:
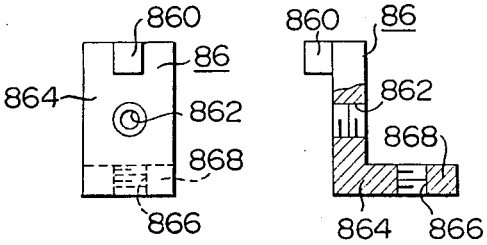
FIG. 9A is a front elevation view of the lateral locking metallic member shown FIGS. 2 and 3.
FIG. 9B is a side elevational view, partly in section of the member shown in FIG. 9A.

Then a lateral locking metallic member 86 as shown in FIGS. 9A and 9B is attached to the metallic plate 70. As shown, the lateral locking metallic member 86 is an L-shaped strip including a protrusion 860 shown in FIG. 9A as being square and disposed at the end of one leg, in this case, the vertical leg as viewed in FIG. 9B of the L and a threaded hole 862 disposed on the intermediate portion of that vertical leg. The other leg 864 of the L includes a threaded hole 866 adjacent to the free end 868.

Referring back to FIG. 2, the protrusion 860 of the lateral locking metallic member 86 is inserted into a hole 70A in the metallic plate 70 located adjacent to the central recess 418 on the second side plate 40 contacted by the metallic plate 70. The lateral locking metallic member 86 is designed and constructed so that with the protrusion 860 inserted into the hole 70A the one leg is inserted into the recess 424 of the outermost second side plate 40 shown in FIG. 7F or 7G, the threaded hole 862 is aligned with a hole 70B in the metallic plate adjacent to the hole 70A, the other leg 864 is inserted into the notch 418 in the outermost second side plate 40, shown in FIGS. 7F and 7G flush with the exposed side surface of the side plate and the threaded hole 866 is aligned with through hole 610 on the supporting strut 60 which is later disposed on the exposed end surface of the that side plate 40. Then a screw 88 is threaded into the hole 70A in the metallic plate 70 with a spring washer 90 interposed therebetween and then screw threaded in the hole 862 on the lateral locking metallic member 86 resulting in the fixing of the lateral locking member 86 to the metallic plate.

Then another lateral locking metallic member 86 is fixed to the metallic plate 72 in the manner as described above.

Following this a supporting strut 60 is disposed on the end surface of the outermost second side plate 70 with the notches 600 and 602 therein are fitted onto the left-hand lateral edges 166 and 206 of the source and load terminals 10 and 20 respectively and is fixed to the lateral locking member 86 by means of a screw such as shown by the reference numeral 92 in FIG. 2 threaded into a spring washer such as a spring washer 84 shown in FIG. 2 and then through hole 610 therein and then screw threaded into the threaded hole 866 in the lateral locking member 86. This results in the fixing of the supporting strut 60 to the lateral locking member 86.

The process as described above is repeated with the metallic plate 72 to fix another supporting strut 60 to another lateral locking metallic member 86.

Subsequently a pair of supporting struts 60 interconnected back to back are fixed on each of the pairs of first and second plates 30 and 40 interconnected back to back and disposed between the phases A and B and between the phases B and C respectively. To this end, an intermediate locking metallic member 96 as shown in FIGS. 10A and 10B is inserted into the recesses 318 and 418 in the interconnected first and second side plates 30 and 40.

Figures 10A, 10B:
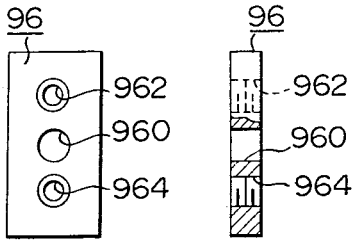
FIG. 10A is a front elevation view of the intermediate locking metallic member shown in FIGS. 2 and 3.
FIG. 10B is a side elevational view, partly in section of the member shown in FIG. 10A.

In FIGS. 10A and 10B the intermediate locking metallic member 96 is shown as being in the form of a rectangular strip including a central hole 960 and a pair of threaded holes 962 and 964 disposed adjacent to the central hole 960 and aligned with one another on the longitudinal axis thereof. The intermediate locking member 96 is so dimensioned that it can be inserted into the connected recesses 318 and 418 on the first and second side plate 30 and 34 interconnected back to back to fully fill those recesses and be flush the connected side surfaces of those side plates when disposed in those recesses 318 and 418. The intermediate locking member 96 has the central hole aligned with a nut formed of the two semihexagonal nuts 422 embedded in the first and second side plates 30 and 40 and has the threaded holes 962 and 964 aligned with the through holes 610 in the supporting struts 60 connected back to back to each other.

Therefore a screw 98 can be threaded into the central hole 960 in the intermediate locking member 96 flush with the side surfaces of the interconnected first and second side plates 30 and 40 and then screw threaded into the nut formed of semi-nuts 322 and 422 as described above. Thus the intermediate locking member 96 is fixed to the interconnected first and second side plates 30 and 40.

Thereafter, a pair of supporting struts 60 are connected back to back to each other by inserting the raised portions 604A, 606A and 608A on one of the struts into the recesses 604B, 606B and 608B respectively with a narrow space left between the main bodies thereof as shown in FIG. 3. Then each pair of supporting struts 60 thus connected are placed against the side surfaces of the associated interconnected first and second side plates 30 and 40 and the intermediate locking member 96 fixed thereto with the notches 600 and 602 thereon fitted onto the lateral edges of the mating source and load terminals 10 and 20 respectively and with front surfaces of the side plate flush with the lateral surface of the adjacent supporting strut 60. Following this a screw 92 is threaded into the through hole 610 in each of the connected supporting struts 60 with a spring washer 94 interposed therebetween and then screw threaded into the threaded holes 962 and 964 respectively. Thus the pair of connected supporting struts 60 are fixed to each of the intermediate locking members 86 whereupon the assembling operation is completed.

The resulting structure is shown in FIG. 3. From the foregoing it is seen that the present invention provides a terminal assembly for a circuit interrupter which is very easily assembled because a plurality of pairs of opposite source and load terminals carried between associated first and second side plates are connected together into a unitary structure with the first and second side plates and a pair of bolts extend through the unitary structure sandwiched between a pair of metallic plates to maintain the unitary structure rigid. Further a pair of supporting struts support an end portion of each pair of source and load terminals to prevent those terminals from shifting due to magnetic force developed thereon. This measure is effective for preventing associated equipment from being damaged.

While the present invention has been illustrated and described in conjunction with a single preferred embodiment thereof it is to be understood that numerous changes and modifications may be resorted to without departing from the spirit and scope of the present invention.

What we claim is:

1. A terminal assembly for a circuit interrupter, comprising:

a plurality of pairs of metallic spaced parallel flat load terminals with the flat surfaces of the terminals of a pair opposed to each other, said pairs of terminals being positioned side-by-side with spaces therebetween, there being one pair for each phase of the interrupter;

a plurality of side walls of insulating material, two between each side-by-side pair of terminals and abutting each other, and two end walls of insulating material on the outside of the outermost pairs of said terminals, said side walls and end walls having groove means therein in which the side edges of said terminals are engaged for being held between spaced opposed walls on the opposite sides of said terminals, said terminals projecting outwardly from between said side walls and said end walls past the edges of said walls on one side of said assembly;

a pair of metallic plates over the outer surface of said end walls, and a plurality of bolts extending through said metallic plates and through said walls and holding said plates, walls and terminals in the assembled condition;

a plurality of struts of insulating material, one on the edge of each of said walls past which said terminals project, the struts having notches in the sides thereof facing said terminals in which the edges of said terminals are engaged, the struts on the edges of the side walls having projection on the sides facing away from said terminals and mating recesses in the sides of the struts toward which said projection extend and in which said projections engage for holding said struts rigidly in engagement with each other and being at least at the ends of the struts, said projections being longer than the depth of said recesses for causing the opposed sides of the struts facing away from said terminals to be spaced from each other; and fastening means only at the centers of the length of said struts holding said struts which are against the edges of said side walls to said side walls and holding said struts which are against the end walls against the respective metallic plates.

2. A terminal assembly as claimed in claim 1 in which said projections of said struts lie along one edge of the side of the struts facing away from said terminals and said recesses lie in the other edge, whereby said struts are interchangeable.

3. A terminal assembly as claimed in claim 1 in which said fastening means for the struts for said side plates comprise a fastening element having the center secured between the two abutting side plates and extending laterally of the edges of said plates, and fastening screw means extending through each of the struts on the corresponding side plates and secured to the ends of said fastener element.

4. A terminal assembly as claimed in claim 3 in which each of said abutting side plates has half nut embedded in the surface thereof which mates with a corresponding half nut in the other abutting plate for forming a full nut, and said fastening element has a further bolt therethrough threaded into said nut.

* * * * *